US005647230A

United States Patent [19]

So et al.

[11] Patent Number: 5,647,230

[45] Date of Patent: Jul. 15, 1997

[54] NEEDLE SELECTION MECHANISM FOR CIRCULAR KNITTING MACHINE

[75] Inventors: Hidetoshi So; Shinji Hashihiro, both of Hyogo, Japan

[73] Assignee: Precision Fukuhara Works, Ltd., Japan

[21] Appl. No.: 587,100

[22] Filed: Jan. 11, 1996

[30] Foreign Application Priority Data

Jan. 13, 1995 [JP] Japan ..... 7-020998

[51] Int. Cl.[6] ..... D04B 15/66; D04B 15/82

[52] U.S. Cl. ..... 66/224; 66/222; 66/227

[58] Field of Search ..... 66/222, 224, 227

[56] References Cited

U.S. PATENT DOCUMENTS

| | | | |
|---|---|---|---|
| 3,747,371 | 7/1973 | Comas | 66/224 |
| 4,604,877 | 8/1986 | Sawazaki et al. | 66/224 |

FOREIGN PATENT DOCUMENTS

| | | | |
|---|---|---|---|
| 0026425 | 4/1981 | European Pat. Off. . | |
| 0185766 | 7/1986 | European Pat. Off. . | |
| 0496133 | 7/1992 | European Pat. Off. . | |
| 1313685 | 11/1962 | France | 66/224 |
| 2153679 | 5/1973 | Germany | 66/224 |
| 476620 | 12/1937 | United Kingdom | 66/224 |

*Primary Examiner*—John J. Calvert
*Attorney, Agent, or Firm*—Bell, Seltzer, Park & Gibson, P.A.

[57] ABSTRACT

Spring jacks are supported for vertical movement in the grooves of the needle cylinder below the needles and select the needles for the control cam to move from the welting position to the knitting or tucking position and to return the needle to the welting position. Jack actuating cams move the spring jacks upwardly to move the needles into operative position with respect to the control cam. The spring jacks are resilient and deflect from an active position to an inactive position out of operative association with an actuating cam. A pattern mechanism selects individual spring jacks in accordance with a predetermined pattern. A selector jack is mounted in each groove in the needle cylinder below the spring jack for limited inward and outward movement and an upper end portion engages a lower end portion of the spring jack. A stack of selector slides operate with the pattern mechanism and each of the selector slides is mounted for individual movement from inactive positions to active positions. Inner end portions are positioned in the path of the selector jacks as they move with the needle cylinder when the slides are in their active position and have an inwardly inclined portion for moving the selector slides inwardly. A horizontal portion maintains the selector jacks in the innermost position for a predetermined time interval. An outwardly inclined portion controls outward movement of the selector jacks and the return of the spring jacks to their active positions.

1 Claim, 4 Drawing Sheets

NEEDLE SELECTION MECHANISM FOR CIRCULAR KNITTING MACHINE

FIELD OF THE INVENTION

This invention relates to circular knitting machines and more particularly to an improved needle selection mechanism for such circular knitting machines.

BACKGROUND OF THE INVENTION

Jacquard pattern devices for circular knitting machines to produce patterns in the knit fabric are known. Various types of such jacquard pattern devices are available and have been extensively used.

One type of such jacquard pattern devices is disclosed in U.S. Pat. No. 4,604,877, owned by the assignee of this application. In this type of pattern device as installed in a circular knitting machine, knitting needles are controlled by selector jacks, which actuate the knitting needles to cause the needles to move to the knitting, tucking or welting positions. Such selector jacks are also referred to as spring jacks and are engaged with or disengaged from cam races. Therefore, each of the selector jacks can act individually and needle selection is performed by which of the selector jacks are active and inactive.

These selector jacks are resilient or springy and are disengaged from the cam races by being deflected inwardly of the needle cylinder by the pattern device such that the jacks flex. Once the pattern device releases the jacks, the jacks return to their original positions in engagement with the cam races.

While successfully operating the jacks and needles, prior pattern devices have had disadvantages and deficiencies. In such prior pattern devices, the jacks are released from their deflected position in such a manner that the jacks spring back to their original positions violently by their inherent spring force. The jacks strike the surface of the cam race with considerable force, bounce therefrom and create impact shocks in the jacks and cam surface. Such violent action and impact shock frequently cause the jacks to break or burrs to form. Such burrs may break off and lodge in the needle grooves causing malfunctions to occur. Also, the vibration of the selector jacks can interfere with accurate needle selection.

SUMMARY OF THE INVENTION

With the foregoing in mind, it is an object of the present invention to provide a needle selection mechanism which obviates the aforementioned disadvantages and deficiencies. This object is achieved by providing a needle selection mechanism which includes a jacquard pattern device which disengages the selector jacks from the cam races and returns the jacks into engagement with the cam races without violent action or impact shock. The pattern device of the present invention not only deflects the jacks inwardly to withdraw the jacks from the cam races but also controls the outward spring back of the jacks and gently guides the jacks into the cam races without impact shock.

BRIEF DESCRIPTION OF THE DRAWINGS

Some of the objects having been stated, other objects will appear as the description proceeds, when taken in connection with the accompanying drawings in which.

DETAILED DESCRIPTION OF THE ILLUSTRATED EMBODIMENT

Figure 1:
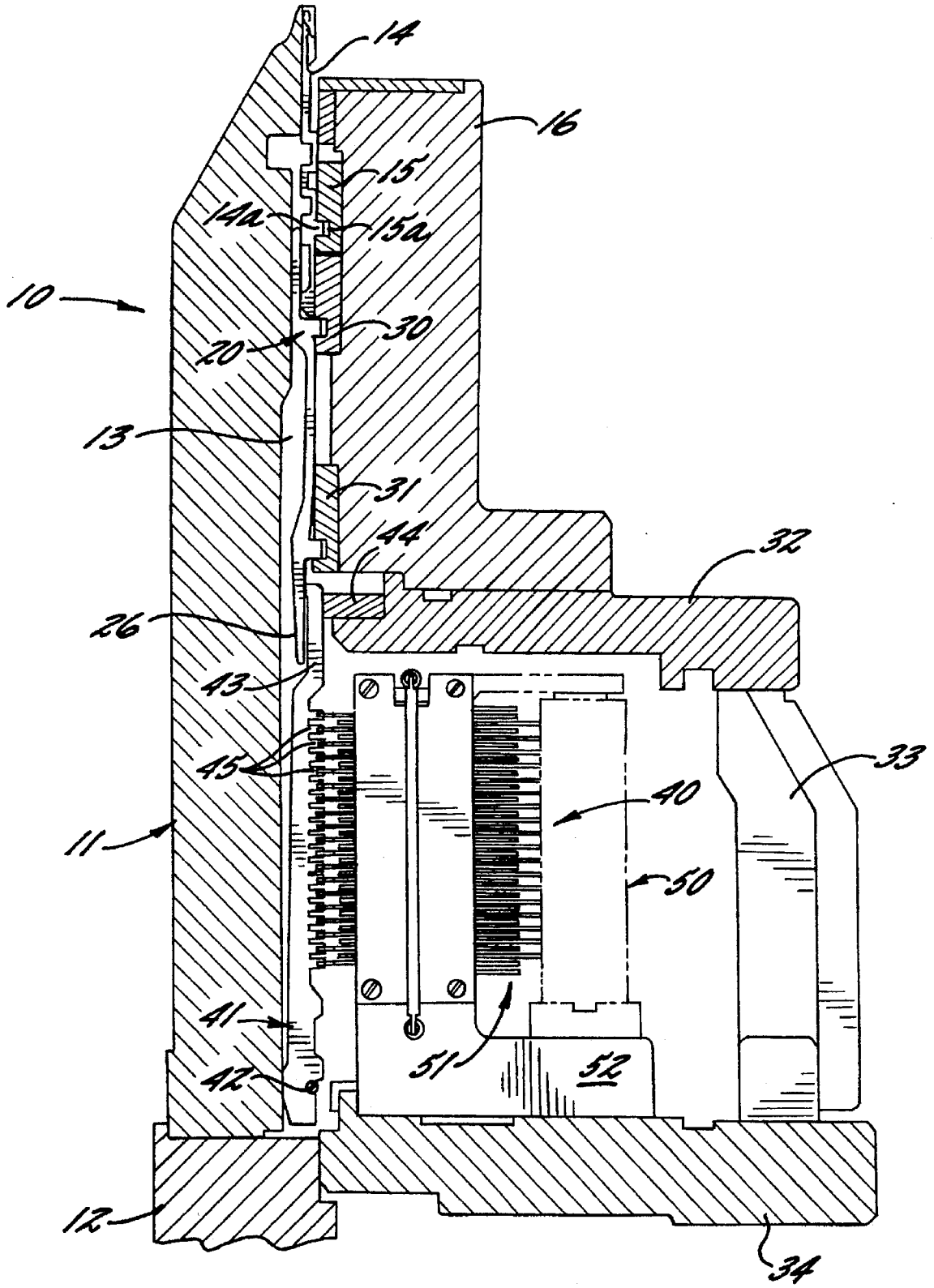
FIG. 1 is a fragmentary vertical section of a circular knitting machine incorporating the present invention.

Referring now more specifically to the drawings, and particularly to FIG. 1, there is illustrated a circular knitting machine, generally indicated at 10, incorporating the present invention. Circular knitting machine 18 includes a needle cylinder 11 supported by a drive gear 12 which is mounted for rotation about a central axis. A multiplicity of needle grooves 13 are provided in the outer periphery of the needle cylinder 11 and extend vertically parallel to the axis of needle cylinder 11.

Each needle groove 13 has a knitting needle 14 slideably mounted therein for vertical movement relative to needle cylinder 11. Each of the knitting needles 14 has an actuating butt **14*a* thereon which is received within a cam race 15*a* of a needle control cam 15 supported in a cam block 16**.

Figure 2:
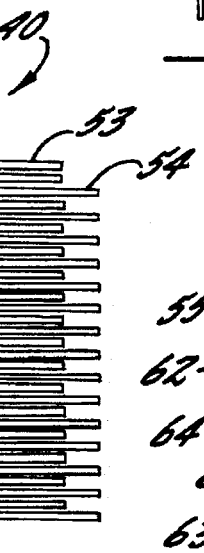
FIG. 2 is a fragmentary, somewhat schematic view of the medial portion of FIG. 1.
Figure 4:
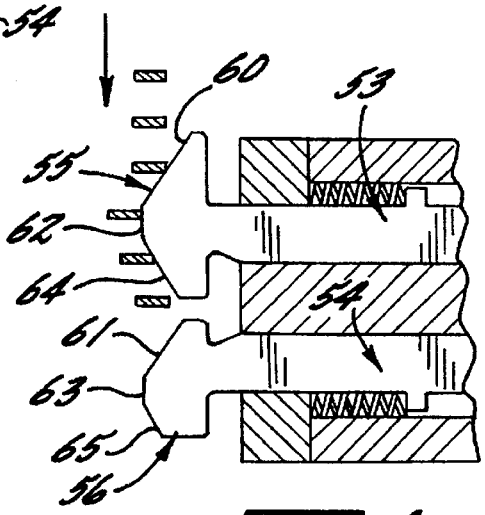
FIG. 4 is an enlarged fragmentary sectional view taken substantially along line 4—4 in FIG. 2.
Figure 5:
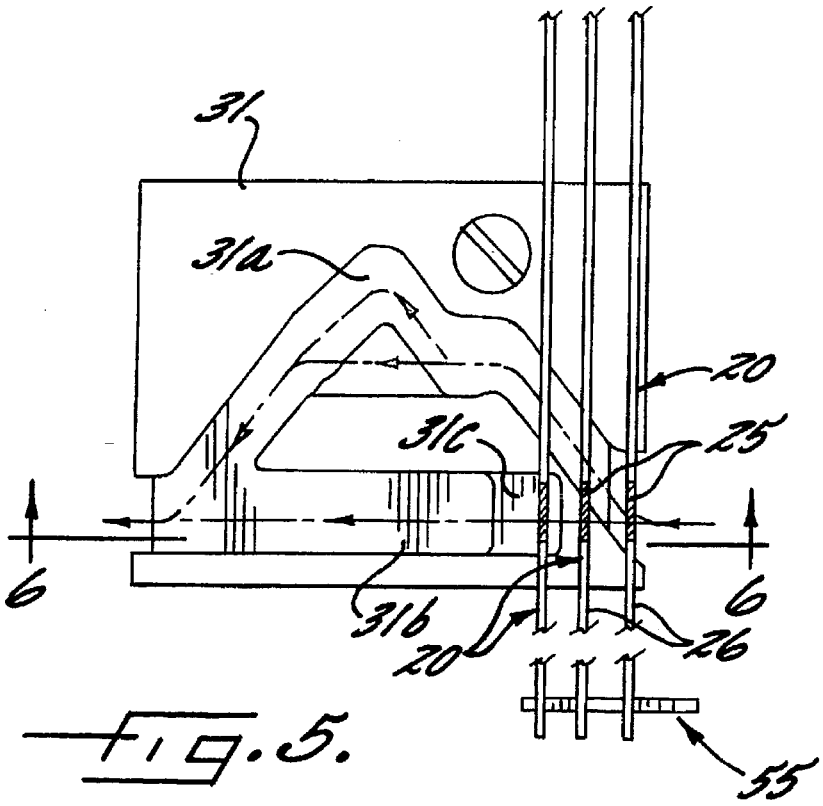
FIG. 5 is a fragmentary elevational view, partially in section, of the lower right hand portion of FIG. 3.

Each groove 13 in needle cylinder 11 also has a spring jack 20 slideably mounted therein immediately below the knitting needle 14. As shown in FIGS. 1 and 2, each of the spring jacks 20 includes an upper end section 21 which extends upwardly and overlaps the lower portion of the needle 14 and maintains the needle 14 outwardly within the grooves 13 in needle cylinder 11 such that the needle contacts the control cam 15 and the butt **14*a* of needle 14 rests within cam race 15*a*. Spring jack 20 also includes an upper butt 22 which has an upper surface defining a shoulder 23 immediately below the upper end portion 21. When the spring jack 20 is raised, the shoulder 23 contacts the lower end of needle 14 and raises needle 14** upwardly.

Spring jack 20 further includes a medial stem portion 24 which has a second butt 25 at the lower end thereof. Finally, spring jack 20 has an extending tail section 26 extending downwardly from the second butt 25 to the lower end of spring jack 20. Each spring jack 20 is resilient and has a springiness which permits the same to be flexed or deflected inwardly from its normal active position to a deflected inactive position and then to spring back to its normal, active position.

The upper butt 22 is positioned in a cam race **30*a* of a lowering cam 30 which is also carried by the cam block 16. Lower butt 25 is associated with a cam race 31*a* of a raising cam 31. Cam 31 is also carried by the cam block 16 at the lower end thereof. The cam block 16 is supported on a cam support 32 which, in turn, is supported in a cantilever manner by four to six support columns 33 carried by a lower cam ring 34**.

The cam support 32 and the lower cam ring 34 define a space therebetween in which is positioned a needle selection mechanism generally indicated at 40. The needle selection mechanism 40 includes a selector or pattern jack 41 positioned in each needle groove 13 of needle cylinder 11 beneath the spring jack 20. The lower portion of each of the selector jacks 41 is engaged by a coil spring 42 which mounts the selector jacks 41 for limited rocking movement within the needle groove 13. The upper end portions 43 of the selector jacks 41 overlap the extending tail sections 26 of the spring jacks 20 on the outside of such tail sections relative to the axis of the needle cylinder 11. A stop plate 44 is carried by the cam support 32 to limit outward movement of the selector jacks 41 to maintain the same in position relative to the spring jacks 20. The medial portions of the selector jacks 41 include a plurality of butts 45 which are formed on the outer side of the medial portions and are spaced apart a predetermined distance so that there is clearance between adjacent pairs of such butts.

The needle selection device 40 includes a pattern drum indicated generally at 50. Pattern drum 50 may be an indexable drum as described in U.S. Pat. No. 4,604,877 owned by the same assignee as this application, the disclosure of which is incorporated herein by reference. Pattern drum 50 controls and actuates a slide mechanism generally indicated at 51. The pattern drum 50 and the slide selector means 51 are mounted on a support bracket 52 which, in turn, is mounted on the lower cam ring 34.

The slide selector means 51 includes a pair of side-by-side stacks of selector slides or pushers, referred to as welt selector slides or pushers 53 and tuck selector slides or pushers 54, which are supported for individual horizontal sliding movement between innermost and outermost radial positions relative to the needle cylinder 11. Each of the selector pushers 53, 54 is supported in grooves in the support bracket The inner ends or heads of the selector pushers 53 and 54 are generally indicated at 55 and 56. Heads 55 and 56 are vertically aligned with the butts 45 of the selector jacks 41. The heads 55, 56 of the pushers 53 and 54 include first angle portions 60, 61 that gradually push the selector jacks 41 inwardly of the grooves 13 in needle cylinder 11 until the selector jacks 41 reach their innermost position. Horizontal sections 62, 63 are provided in the medial portion of the heads 55, 56 of pushers 53 and 54 to maintain the selector jacks 41 in the innermost position for a predetermined length of time. Finally, heads 55 and 56 of pushers 53 and 54 include outwardly angled portions 64, 65 which control the outward movement of the selector jacks 41 as the selector jacks 41 are moved outwardly by the action of the spring jacks 20. The angle of the outwardly angled portions 64 and 65 is preferably about 15° to 30° and, more preferably, between about 20° to 25°.

Figure 6:
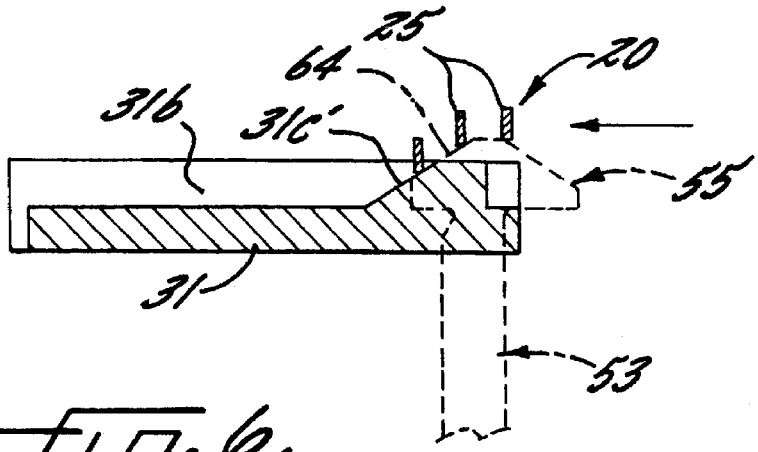
FIG. 6 is a fragmentary sectional view taken substantially along the line 6—6 in FIG. 5.

Each of the selector cams 31 includes an upper cam race **31*a* which raises the jacks 20 upwardly by the lower butts 25. Cams 31 also include a lower race 31*b* which receives the lower butts 25 on spring jacks 20 when the spring jacks 20 are returned to their outermost position by the selector jacks 41. Preferably, the entry ends of the races 31*b* have angled portions 31*c* which guide the butts 25 of the spring jacks 20 into the races 31*b* of cams 31 in a smooth and gentle manner. As illustrated in FIG. 6, the angled portion 31*c* into race 31*b* comprises an extension of the outwardly angled portions 64 and 65 of the heads 55, 56 of pusher members 53 and 54. Therefore, there is a smooth transition of control of the butts 25 and thus the spring jacks 20 as the spring jacks 20 return to their outermost position and into the race 31*b* of the lifting cam 31. With the butts 25 in the race 31*b*, the spring jacks 20 are maintained in the lower position and the needles 14 are located in the welt position. The exit end of the cam race 31*b* is aligned with the entry end of the cam race 31*a* of the next succeeding lifting cam 31 so that the butt 25 of the spring jack 20 will enter the cam race 31*a* unless that spring jack 20** is again deflected inwardly.

When the butts 25 are located in cam race **31*a*, the spring jacks 20 are lifted upwardly and the needles 14 are also lifted upwardly to the cam race 15*a* of control cam 15 which raises the needle 14 to the tuck or knitting position. When the spring jacks 20 reach the top of cam race 31*a*, the cam race 31*a* and the race 30*a* of lowering cams 30 lower the spring jacks 20 back to the lower position thereby permitting control cam 15 to lower the needles 14** to the welt position.

While a pattern drum as illustrated and described in U.S. Pat. No. 4,604,877 have been described herein, other needle selector means may be employed. For example, a piezo electric needle selector of the type disclosed in Japanese patent publication No. 94619 of 1994 could be utilized. Alternatively, an electromagnetic needle selector could be used as disclosed in Japanese Patent Laid Open No. 289154 of 1990.

Figure 3:
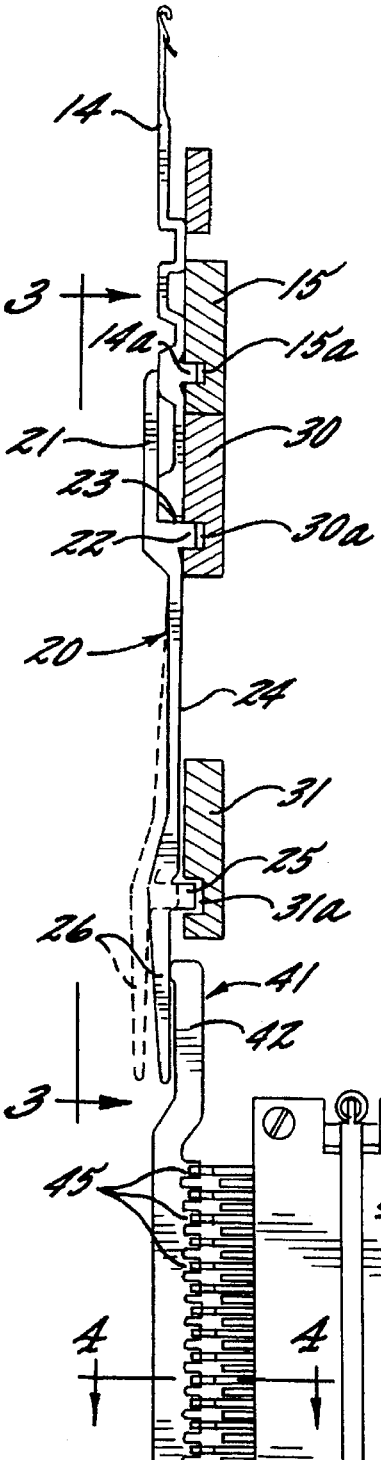
FIG. 3 is a fragmentary elevational view looking generally in the direction of the arrows 3—3 in FIG. 2.
Figure 3:
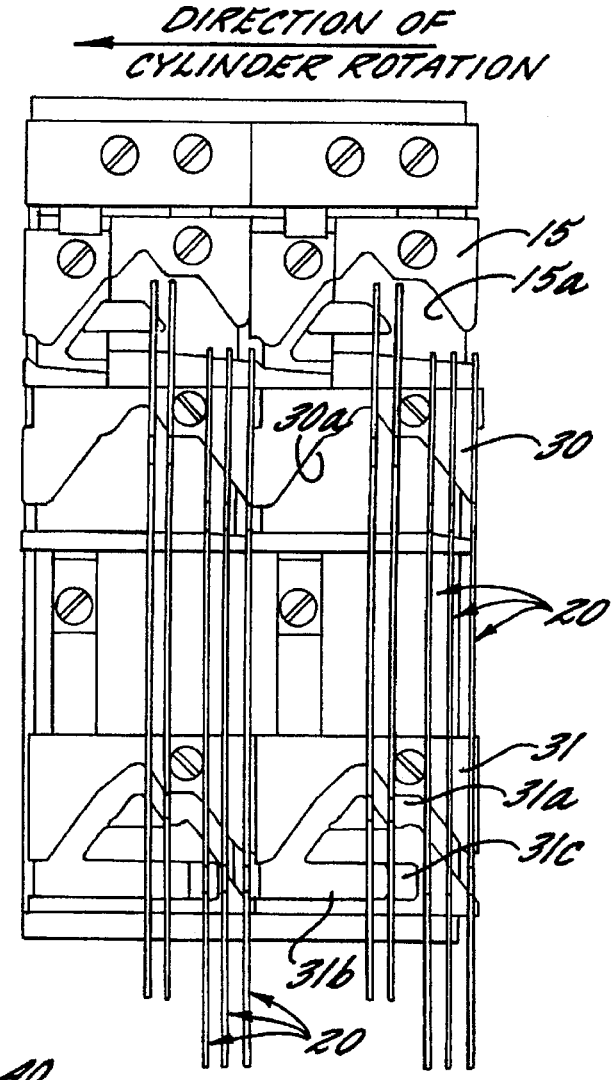

In operation, as illustrated for example in FIG. 3, the needle cylinder 11 rotates in the direction of the arrow at the top of FIG. 3. At the same time, the pattern drum 50 either advances the pushers 53, 54 or maintains the same in a retracted position. When the pushers 53 and 54 are not advanced, the selector jacks 41 remain in the outward position and keeps on moving sideways past the stacks of slides.

Because selector jack 41 is not moved inwardly, the spring jack 20 maintains its normal position with the lower butt 25 in position to enter the cam race **31*a* of lifting cam 31. Lower butt 25 enters cam race 31*a* and the spring jack 20 is lifted upwardly thereby such that the shoulder 23 engages the lower end of needle 14 and raises needle 14 upwardly such that it enters the cam race 15*a* of control cam 15**.

Once the spring jack butts 25 and 22 reach the top of cam races **31*a* and 30*a*, the cam races 30*a* and 31*a* lower the spring jack 20 downwardly to its lowermost position. The needle continues rising under the action of cam race 15*a* of control cam 15 until it reaches the knitting position where it picks up a yarn from a yarn feeder (not shown) and then is lowered by the control cam 15** in a knitting operation that is common and well known.

When the pattern mechanism advances the pusher members 53 and 54, the outwardly angled portions 60 and 61 engage the butts 45 of the selector jack 41. As the selector jack 41 moves relative to the pusher member 53 or 54, the selector jack 41 is gradually moved inwardly against the resilience of the spring jack 20 until the selector jack 41 reaches the horizontal section 62 or 63. During this inward movement, the selector jack upper end portion 42 presses against the extending tail section 26 of the spring jack 20 deflecting the lower portion of the spring jack 20 inwardly to move the lower butt 25 away from the cam race **31*a* such that the butt 25 does not enter the cam race 31*a***.

The butt 45 of the selector jack 41 moves along the horizontal section 62 or 63 until it reaches the outwardly angled portion 64 or 65. As the cylinder 11 continues to rotate, the butt 45 moves along the outwardly angled portion 64 or 65 and the selector jack 41 is moved outwardly by the spring force of the spring jack 20. In this manner, the outward movement of the selector jack 41 and spring jack 20 is controlled by the outwardly angled portions 64 and 65 of the pusher members 53 and 54. As the selector jack 41 nears its outer position, the butt 45 thereof nears the outer end of the angled portion 64 or 65. At the same time, the butt 25 of spring jack 20 is guided into contact with the angled portion **31*c* of cam 31 which comprises an extension of the outwardly angled portion 64 or 65 and continues to control and gently guide the spring jack 20 in its return to its normal, active position. When the butt 25 of spring jack 20 enters the cam race 31***b* at the outer end of the angled portion 31*c*, the spring jack 20 has then reached its normal, active position and the selector jack 41 has passed beyond the angled portions 64 and 65 of pusher members 53 and 54. Since cam race 31*b* does not raise the spring jack 20, the needle 14 also is not raised and remains in the welting position.

Figure 7:
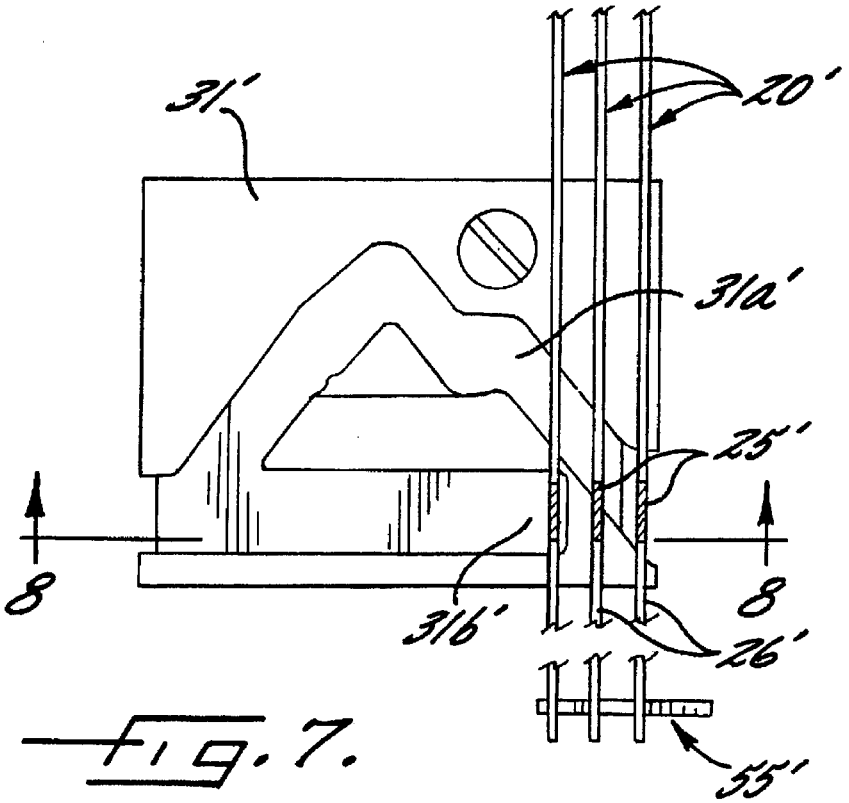
FIG. 7 is a view similar to FIG. 5 illustrating another embodiment of the present invention.
Figure 8:
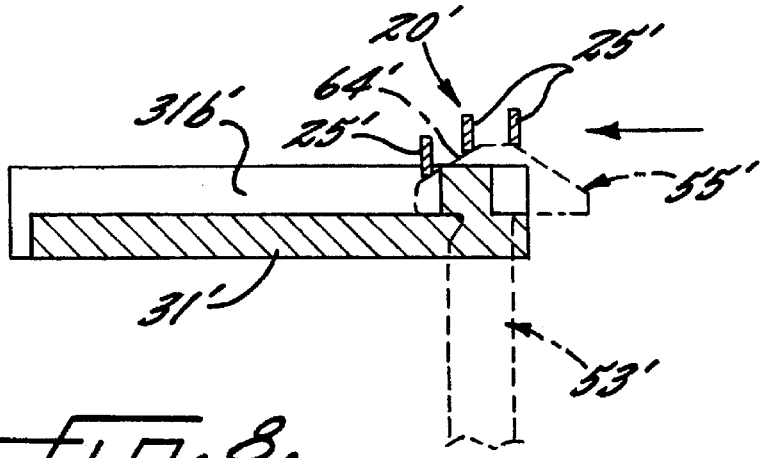
FIG. 8 is a fragmentary sectional view taken substantially along line 8—8 in FIG. 7.

Referring now to FIGS. 7 and 8, another embodiment of the present invention is illustrated. In this embodiment, like reference characters are used to indicate like parts with the prime notation added. Referring to FIG. 7, there is illustrated spring jacks 20' which are identical to spring jacks 20. Also illustrated is a lifting cam 31' having an active cam race 31*a'* and a lower or welt cam race 31*b'*. In this embodiment, the angled portion 31*c* of cam race 31*b'* is omitted and control of the spring jacks being returned into the race 31*b'* is under the sole control of the pusher member 53' and the outwardly angled portions 64' thereof. Since the outwardly angled portion 64' releases the selector jack 20' only a short distance before the spring jack 20' reaches its outermost position, little or no impact shock is created when the spring jack's lower butt 25' drops into the cam race In the drawings and the specification, there has been set forth preferred embodiments of the invention, and, although specific terms are employed, the terms are used in a generic and descriptive sense only and not for the purpose of limitation, the scope of the invention being set forth in the following claims.

We claim:

1. A circular knitting machine for knitting fabric having patterns therein and comprising a needle cylinder rotatable about a vertical axis and having a multiplicity of grooves in the outer periphery parallel to said axis, a knitting needle slidably mounted in each of said grooves in said needle cylinder, said needles being adapted for movement between knitting, tucking and welting positions, control cam means operatively associated with said knitting needles for moving selected needles between the knitting, tucking and welting positions as said needle cylinder rotates, a spring jack slidably mounted in each of said grooves in said needle cylinder below said knitting needle and adapted to contact said knitting needle to raise said needle upwardly upon upward movement of said spring jacks, said spring jacks being resilient and having a lower portion mounted for flexure movement inwardly to an inactive position and outwardly to an active position normally occupied by said spring jack, each of said spring jacks having a butt thereon, spring jack cam means operatively associated with said spring jacks for raising and lowering said spring jacks occupying said active position, said spring jack cam means comprising a spring jack actuating cam having a first race for raising said spring jacks and a second race for maintaining said spring jacks in said lower position, said second cam race having an angled portion at an entry end thereof for smoothly and gently guiding said spring jack butt into said second race upon return of said spring jacks to the active position, and needle selection means for selecting and moving individual spring jacks from the active position to the inactive position to cause said needles to knit, tuck and welt selectively to knit a fabric having a predetermined pattern therein, said needle selection means including means for selecting individual spring jacks in accordance with a predetermined pattern and means for deflecting said lower portions of said spring jacks from said active position to said inactive position to disengage said spring jacks from said actuating cam means and to control said spring jacks return to said active position in a gentle manner so that impact shock between said spring jacks and said actuating cam means is prevented, said selecting means and said deflecting means comprising a selector jack mounted in each of said grooves in said needle cylinder below said spring jack for limited inward and outward movement and having an upper end portion engageable with the lower portion of said spring jack for deflecting said lower portion of said spring jack from said active position to said inactive position, pusher means engageable with selected ones of said selector jacks for moving said selected selector jacks inwardly to deflect said lower portions of said spring jacks from said active position to said inactive position, said pusher means comprising a stack of selector slides mounted for individual horizontal movement between innermost, active positions and outermost, inactive positions and having inner ends aligned with and disposed in the path of said selector jacks when said selector slides are in said active position, said inner end of said selector slide having an inwardly angled portion for moving said selector jack inwardly, a horizontal portion for maintaining said selector jack in the innermost position for a predetermined time interval, and an outwardly angled portion for controlling the movement of said selector jack to the outermost position.

* * * * *